United States Patent [19]

Yamada et al.

[11] Patent Number: 4,822,105

[45] Date of Patent: Apr. 18, 1989

[54] DOUBLE ENDED RANGING DRUM SHEARER AND METHOD OF CONTROLLING WORKING HEIGHT IN MINING FACE IN USE OF THE SAME

[75] Inventors: Ryuji Yamada; Shoji Igata, both of Oomuta, Japan

[73] Assignee: Mitsui Miike Machinery Company, Limited, Tokyo, Japan

[21] Appl. No.: 98,474

[22] Filed: Sep. 18, 1987

[30] Foreign Application Priority Data

Sep. 26, 1986 [JP] Japan ..... 61-227697

[51] Int. Cl.[4] ..... E21C 35/08; E21C 35/24

[52] U.S. Cl. ..... 299/1; 299/42

[58] Field of Search ..... 299/1, 42, 43, 30

[56] References Cited

U.S. PATENT DOCUMENTS

| | | | |
|---|---|---|---|
| 3,371,964 | 3/1968 | Weber | 299/1 |
| 4,008,921 | 2/1977 | Czauderna et al. | 299/1 |
| 4,130,319 | 12/1978 | Gapper | 299/1 |
| 4,371,209 | 2/1983 | Alford et al. | 299/1 |
| 4,634,186 | 1/1987 | Pease | 299/1 |
| 4,715,657 | 12/1987 | Sato et al. | 299/1 |

FOREIGN PATENT DOCUMENTS

| | | | |
|---|---|---|---|
| 2429774 | 8/1976 | Fed. Rep. of Germany | 299/1 |
| 2144466 | 2/1985 | United Kingdom | 299/1 |
| 2174443 | 11/1986 | United Kingdom | 299/1 |

*Primary Examiner*—Stephen J. Novosad
*Assistant Examiner*—David J. Bagnell
*Attorney, Agent, or Firm*—Stevens, Davis, Miller & Mosher

[57] ABSTRACT

A double ended ranging drum shearer is provided with a shearer body and a pair of drums disposed at front and rear end portions of the shearer body to be movable up- and down-wardly. The shearer is further equipped with detectors for respectively detecting the travelling position of the shearer body, detecting the inclination of the shearer body at the travelled position, and detecting the heights of drums at the travelled position. These detectors are operatively connected to a controlling device which is connected to a drum height adjusting device. The controlling device operates and stores the drum heights necessary for keeping constant the working height of a mining face in a pit in accordance with output signals generated from the abovementioned detectors, and the drum height adjusting device is operated in response to an output transmitted from the controlling device representing the thus operated and stored data.

5 Claims, 7 Drawing Sheets

DOUBLE ENDED RANGING DRUM SHEARER AND METHOD OF CONTROLLING WORKING HEIGHT IN MINING FACE IN USE OF THE SAME

BACKGROUND OF THE INVENTION

This invention relates to a double ended ranging drum shearer (hereinafter referred to simply as "shearer") used for a long-wall mining having a working height controller capable of automatically controlling the elevating movement of cutting drums provided for the shearer to thereby keep constant the working height at a mining face, and relates to a method of controlling the working height to be constant in use of the double ranging shearer of the character described above.

With a conventional long wall mining plant, two operators are generally required for operating a double ranging shearer, one for manipulating the front drum and observing the cutting condition and speed of the shearer in a front, i.e., advancing, direction and the other for manipulating the rear drum and observing the cutting and loading condition of the rear drum at the rear portion, and much experience and expert skill are required for these observations and manipulating. The mining working is usually carried out by adjusting or regulating the drum height and shearer speed in accordance with the roof and floor conditions in a mining pit which vary intricately.

Although it may be possible for one operator to control the shearer under good conditions of a mining pit wherein a mining face such as a coal face is substantially straight and a coal seam has a constant thickness, in such a case, the rear side drum is not usually operated and is maintained at an appropriate position between the roof and the floor of the mining face.

As described hereinabove, in the conventional mining working in use of a shearer, two skilled operators have to be disposed at the front and rear portions of the cutter, and the two operators have paid attention to a coincidence of their operation timings for mining the coal face while properly maintaining the constant working height.

The following two managing items are deemed to be most important ones in the working of the mining face:

(a) to keep the mining face straight; and (b) to keep the working height as constant as possible so as to make easy the operation and management of shield supports to hold the roof of the mining face.

The item (a) is managed by an operator who manages the shield supports and the item (b) is managed by an operator who operates the shearer.

The operators should always pay attention to the mutual relationship in height of the front and rear drums of the shearer because the working height at the mining face is determined by the respective heights of these drums. The determination of the working height may be relatively easily done in a case where the floor (or roof) of the mining pit is flat or straight, but in usual, the floor (or roof) is not flat and uneven, and the shearer has a whole length of about 8–10 m, so that it is substantially impossible to keep constant the working height even in the simultaneous operations of both the front and rear drums. Taking the above fact into consideration, it is necessary for the operator who handles the rear drum to always pay attention to the roof condition or height to adjust the working height to be as constant as possible.

Recently, however, on the basis of the improvement of the working condition and the environmental sanitation in the mining pit, a radio controlling unit has been equipped for the shearer thereby to remotely control the same by one operator at a windward position without being exposed to dust and dirt.

In this remotely controlled operation, although the height and the cutting condition of the front drum can be adequately observed and managed, the observation and management of the rear drum can hardly be done because the rear drum is separated by more than about 10 m from the operator. Accordingly, this remote control operation can possibly be applied only to a mining face in which the coal seam of the coal face is relatively straight and cannot be applied to any mining face exposing various floor conditions.

SUMMARY OF THE IVENTION

An object of this invention is to eliminate defects or drawbacks of the prior art technique for controlling a working height of a mining face in a pit.

Another object of this invention is to provide an improved double ended ranging drum shearer equipped with a working height controlling device capable of mining, for example coal mining while maintaining the working height constant by the operation of one operator under any condition of the mining face.

A further object of this invention is to provide a method of controlling a working height of a mining face in a pit using an improved double ended ranging drum shearer.

In one aspect, according to this invention, the above objects can be achieved by providing a double ended ranging shearer comprising a shearer body, a pair of drums disposed at front and rear end portions of the shearer body to be movable upwardly and downwardly, a drum height adjusting device operatively connected to the respective drums, a controlling device attached to the shearer body and operatively connected to the drum height adjusting device, a detector connected to the controlling device and adapted to detect heights of the respective drums, a detector connected to the controlling device and adapted to detect an inclination of the shearer body, and a detector connected to the controlling device and adapted to detect travelling positions of the shearer, the controlling device mathematically operating and storing drum heights necessary for keeping constant the working height of the mining face in accordance with the output signals generated from the respective detectors, and the drum height adjusting device being operated in response to an output signal from the controlling device representing the thus operated drum heights.

In another aspect of this invention, there is provided a method of controlling a working height of a mining face in a pit in use of a double ended ranging drum shearer including a shearer body and a pair of drums disposed at front end and rear end portions of the shearer body to be movable upwardly and downwardly through drum height adjusting means, the method comprising the steps of detecting and storing a travelling position of the shearer body, detecting and storing a height of the drums at the travelled position of the shearer body, detecting and storing an inclination of the shearer body at the travelled position thereof, mathematically operating a drum height necessary for keeping constant the working height in accordance with stored data representing the travelling position, the drum height, and the inclination of the shearer body, and operating the drum height adjusting device in accordance with the operated drum height.

According to one preferred embodiment of this invention, during one half operation cycle in one operation cycle in which the shearer is reciprocated between the main gate and the tail gate of the mining face, the front drum is manually operated, and the inclination angle of the shearer body is detected whenever the shearer travels by the present distance (for example 0.5 m). The height of the front drum and the inclination angles of the shearer body at the respective travelled positions of the shearer body are stored by a microcomputor equipped for the controlling device, while the height of the rear drum from the floor is automatically controlled based on the inclination angle of the shearer body detected as the shearer travels. During the other half operation cycle, the both drum heights are controlled in accordance with the data stored in the first half operation cycle so that the working height of a mining face is adjusted to be constant, i.e., to be a height previously set.

DESCRIPTION OF THE PREFERRED EMBODIMENT

Figure 1:
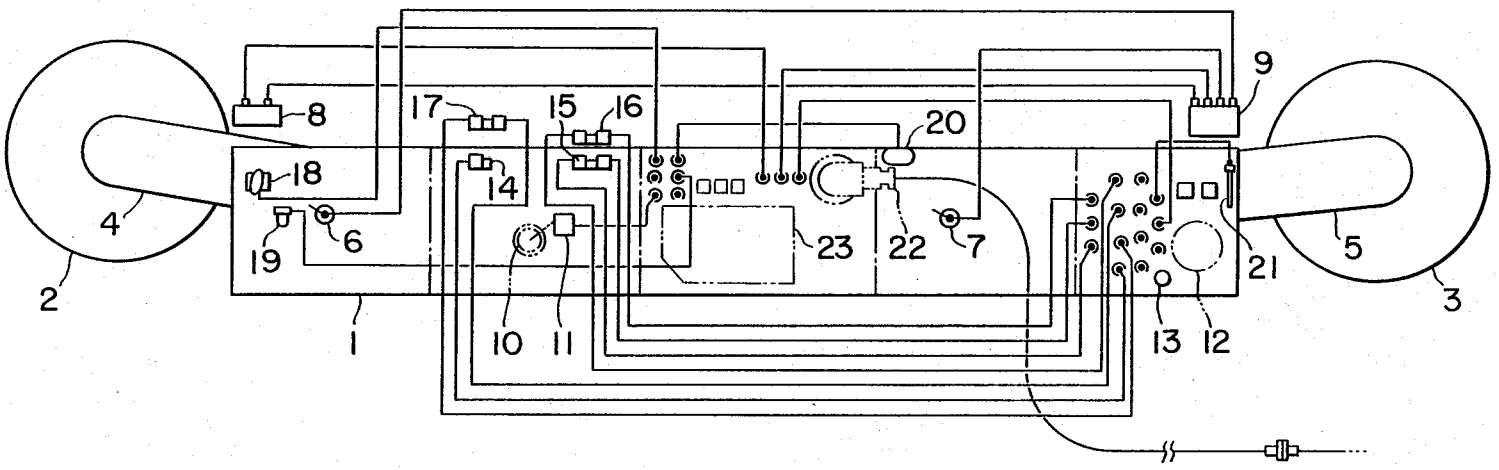
FIG. 1 is a schematic view showing a construction of a double ended ranging drum shearer according to this invention.

FIG. 1 is a schematic view of a double ranging shearer according to this invention in which a body 1 of the shearer is provided with front and rear ends at which a left drum 2 and a right drum 3 are supported through drum height adjusting members, not shown, respectively, to be movable in a vertical direction. The drums 2 and 3 are actually supported by arm members 4 and 5, and potentiometers 6 and 7 are operatively connected to the rotation shafts of the respective arm members 4 and 5 for detecting the heights of the drums 2 and 3. Indicators 8 and 9 for indicating the heights of the drums 2 and 3 are located in the vicinities of both the ends of the shearer body 1. The drum cutter body 1 is driven by a haulage sprocket 10 which is equipped with a pulse generator 11 for detecting the position of the shearer body 1 during the movement thereof. The body 1 is further provided with a control chamber 12 in which is located an inclined angle detector 13 for detecting the inclination of the body 1, and solenoid valve means 14, 15, 16 and 17 are operatively connected to a control chamber 12 for controlling or managing the rightward movement, the leftward movement, the stopping operation of the shearer body 1, and the elevating or lowering movements of the drums 2 and 3, respectively. The shearer body 1 is further equipped with an emergency stop switch 18, a flow switch 19, a tension switch 20, an antenna 21 for the radio control, a plug-socket 22 for the electric power connection, and an electric equipment chamber 23 in which an electric motor, not shown, is accommodated.

In advance of the description of the actual operation of the shearer having the construction described hereinabove, mining systems or methods of the mining face will be explained hereunder.

The mining methods are generally classified into two typical methods, one being a UNI-DI (UNI-DIRECTION) method and the other being a BI-DI (BI-DIRECTION) method. With these methods, a series of operations of the drum cutters, in which the double ranging shearer is shifted to a tail or main gate from a main or tail gate and then returned to the main gate, is called one operation cycle. In the UNI-DI method, a cutting operation is performed in one half cycle of this one operation cycle and a loading operation is alternately performed in the other half cycle, and in the BI-DI method, these cutting and loading operations are always simultaneously carried out during one operation cycle.

In either one of these methods, the operator manually manages or handles the drums during half of the one operation cycle, and the heights of the respective right and left drums at the respective travelling positions and the inclined angle of the shearer body are stored as memories in a micro-computor of a controlling device, this process being called as a teaching mode.

In the remaining half of the one operation cycle, the working height of the mining face is automatically controlled in response to the stored data obtained in the teaching mode to be constant and equal to the height previously set.

In case the mining (i.e., coal) face is constituted by ideal flat or even roof and floor and the mining face has a constant coal height, the operator could drive the cutters automatically in accordance with the controlled mode by the controlling device after he has carried out one exemplary operation to obtain a model operation mode. Actually, however, the roof and the floor of the mining face are usually uneven and descend or ascend in the advancing direction of the mining face in the pit. For this reason, the operator drives the drums while performing amendment of the cutting height of the roof little by little, which is relatively easily amended, in the teaching mode once obtained to appropriately follow up the change of the mining face.

As stated above, it will be understood that the cutting height of the floor should be automatically controlled in accordance with the change of the cutting height of the roof, and in this control, attention should be paid to the fact that the shearer has a whole length of about 8–10 m, which substantially corresponds to the distance between the locations of the front drum for the roof and the rear drum for the floor; that is, the rear drum will have to be controlled to cut the floor in consideration of the height of the roof already cut and the inclination of the cutter body 1 at that operation time.

In this control of the drums, it is significantly necessary to precisely grasp the relationship between the actual position of the floor and the lower end of the drum as an aimed object to be controlled. This is because if the cutting operation is always carried out on the ground of only the aimed object, a certain rapid difference in level of the floor may be caused in accordance with the extent of the amended amount of the roof already cut, which may finally cause difficulty in the operation of the shield supports to be followed.

Accordingly, the cutting device automatically decides the cutting position while confirming that the actual operation of the shield supports should be done smoothly at what height of the drum the cutting operation should be performed in consideration of the relationship between the actual position of the floor and the position of the aimed object.

A microcomputor may be equipped as a controlling device of the character described above to store the heights of the right and left drums and the inclination of the cutter at an optional position, and it will be also possible to store these heights and inclinations at all positions throughout the mining face.

As described above, according to this invention, the height of the right and left, i.e. front and rear, drums (hence the rotation angle of the drum shaft with respect to the shearer body) at the respective points of the mining face can be stored, so that the mutual relationships between the shearer body and the respective drums are continuosly stored. In substantially the same manner, the inclination angles of the shearer at the respective travelling positions can be stored. Accordingly, the floor level condition of the mining face can be calculated on the basis of this series of data and data of the cutter concerning, for example, mechanical dimensions thereof.

In the manner thus mentioned above, the relationship between the shearer body and the respective two drums, and the mutual conditions of the shearer body and the floor can be clearly and precisely grasped at the respective running positions, and accordingly, by carrying out the first half-cycle operation of the drum cutter in accordance with the obtained teaching mode, the next half-cycle operation thereof can be achieved by the playback operation mode thereby to maintain a constant working height of the mining face under the controlled condition.

Bearing the above matters in mind, in the next stage, the concrete and specific operation of the shearer according to this invention will be explained hereunder in conjunction with FIGS. 2 through 9.

First, with the UNI-DIRECTION method, when an operator wants to carry out the cutting operation of the mining, for example coal, face from the main gate to the tail gate of the mining face, the roof is first cut by means of the drum 3 located on the side of the main gate. During this cutting operation, the microcomputer mounted on the shearer body 1 stores the arm angles of the drum 3 and the inclination angles of the shearer body 1 at the respective traveling positions of the coal face. The thus stored operation is utilized as a teaching mode. In the next step, when the shearer returns to the main gate from the tail gate, the floor positions and the working heights at the respective travelling positions are obtained by the calculation based on the arm angles and the inclination angles stored in accordance with the teaching mode, thus determining the arm angle to maintain the height of the coal face. This operation is stored as playback mode. The succeeding operation of the drum cutter is performed by alternately repeating the operations based on the teaching and playback modes.

The principle for detecting the floor condition in accordance with the data regarding the respective travelling positions of the shearer body and the inclination angles of the cutter body will be described with reference to FIG. 2.

Figure 2:
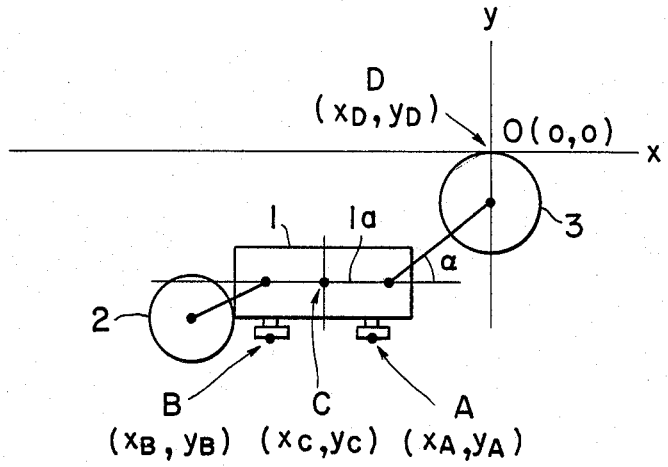
FIGS. 2 through 6 are illustrations of side views of the drum cutter shown in FIG. 1 for explaining a series of operations thereof at a mining face according to one embodiment of the method of this invention.

Referring to FIG. 2, it is supposed that the top point or apex of the main gate at the starting of the teaching mode is regarded as a zero-(0-)point of X-Y coordinates and an X-Y plane is imaged in which a central axis 1*a* of the shearer body 1 in the lengthwise direction thereof is in parallel to the X-axis of the coordinates. The shearer is shifted, while carrying out the cutting operation, in the X-Y plane in the direction along the X-axis and the cutting locus during this cutting operation is grasped. Although, in actual, the shearer body 1 is usually slightly inclined in the direction of gravity due to the condition of the floor of the mining face, the central axis 1*a* is set so as to be in parallel to the X-axis in the X-Y plane utilized for the teaching mode control. With the X-Y plane, for the reason that the inclination angles of the shearer body 1 are not necessarily the same in the respective operations at the starting of the teaching mode operation, new X-Y planes will have to be decided at the respective operations in advance of the operation starting time based on the teaching mode.

Figure 3:
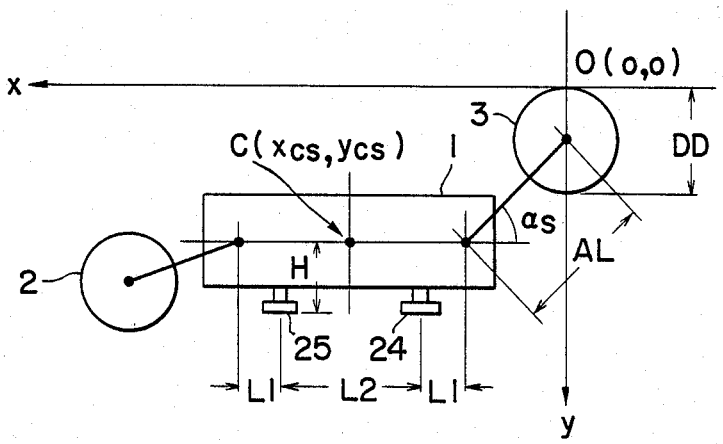
Figure 8:
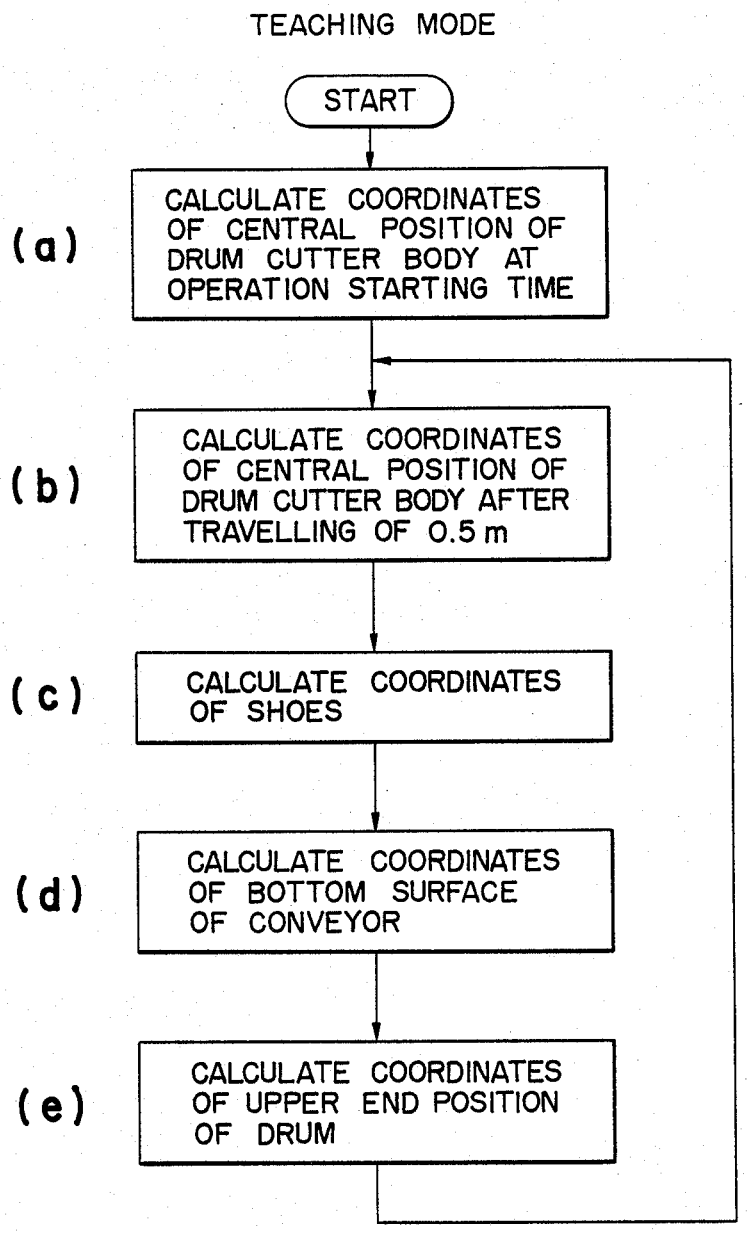
FIGS. 8 and 9 are flowcharts for explaining the controlling manner according to the method of this invention.

At the starting of the operation based on the teaching mode, after the determination of the X-Y plane, the shearer is controlled in accordance with processes shown in FIG. 8 as a flowchart, in which at the first step (a), the coordinates $C(x_{cs}, Y_{cs})$ of the central position of the shearer body 1 are calculated on the basis of the arm angle $\alpha_s$ of the drum 3 at the starting point (see FIG. 3).

$$x_{cs}=AL\cdot\cos(\alpha_s)+L_1+L_2/2$$

$$Y_{cs}=AL\cdot\sin(\alpha_s)+DD/2$$

in which AL is the arm length of the drum 3; $L_1$ is a distance between the fulcrum of the arm and a shoe 24 (25); $L_2$ is a distance between the shoes 24 and 25, and DD is a diameter of the drum 3.

Figure 4:
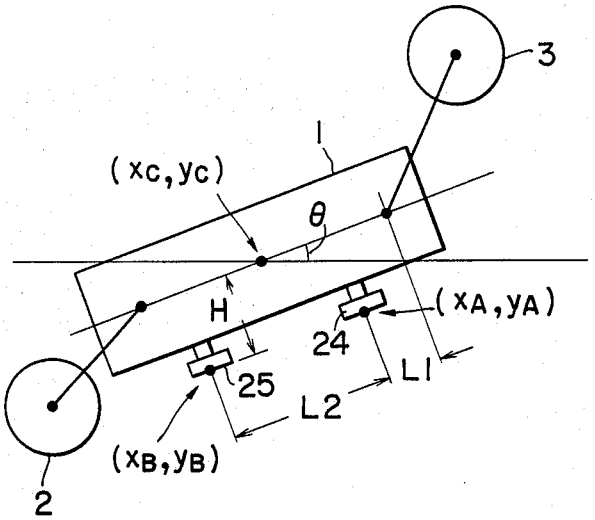

In the next step (b), the coordinates $C(x_c, y_c)$ of the central position of the shearer body 1 are calculated on the basis of the inclination $\theta$ thereof after the shearer body 1 travels by a unit length L (for example, 0.5 m) (see FIG. 4).

$$\theta=\theta_1-\theta_s$$

$$x_c=L\cdot\sin(\theta)+Y_{cs}(\theta\geqq 0)$$

$$Y_c=Y_{cs}-L\cdot\cos(\theta)\ (\theta\leqq 0)$$

in which $\theta_s$ is an inclination of the shearer body 1 at the starting position.

In the step (c), the coordinates $(x_a, y_a)$ and $(x_b, y_b)$ of the left and right shoes 24 and 25 are respectively calculated (see FIG. 4).

$$x_a=x_c-(L_2/2)\cdot\cos(\theta)-H\cdot\sin(\theta)$$

$$Y_a=Y_c-(L_2/2)\cdot\sin(\theta)+H\cdot\cos(\theta)$$

$$x_b=x_c+(L_2/2)\cdot\cos(\theta)-H\cdot\sin(\theta)$$

$$Y_b=Y_c-L_2/2)\cdot\sin(\theta)+H\cdot\cos(\theta)$$

In the subsequent step (d), the coordinates $(x_e, Y_e)$ of the bottom surface of a conveyer, not shown, located below the shoes 24 and 25 are calculated. Moreover, the coordinates of the bottom portion of a conveyer disposed in the mining face are also calculated in substantially the identical manner to that applied for calculating the coordinates of the shoes 24 and 25 because the height from the bottom surface of the conveyor to the shoes 25 and 24 is always constant and the heights of the shoes themselves are easily measured.

Figure 5:
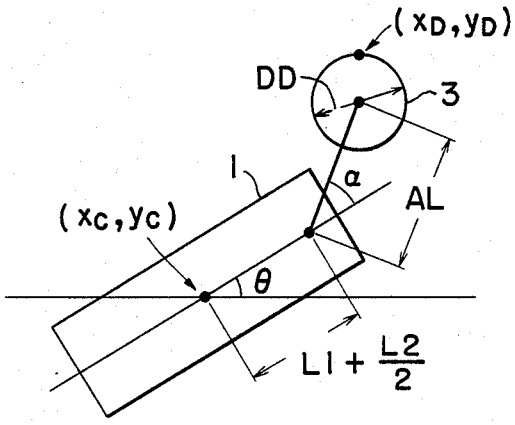

The coordinates ($x_d$, $Y_d$) of the top point of the drum 3 are calculated as follows in the next step (d) (see FIG. 5).

$$x_d = x_c - (L_1 + L_2/2) \cdot \cos(\theta) - AL \cdot \cos(\theta + \alpha)$$

$$Y_d = Y_c - (L_1 + L_2/2) \cdot \sin(\theta) - AL \cdot \cos(\theta + \alpha) - DD/2$$

Figure 6:
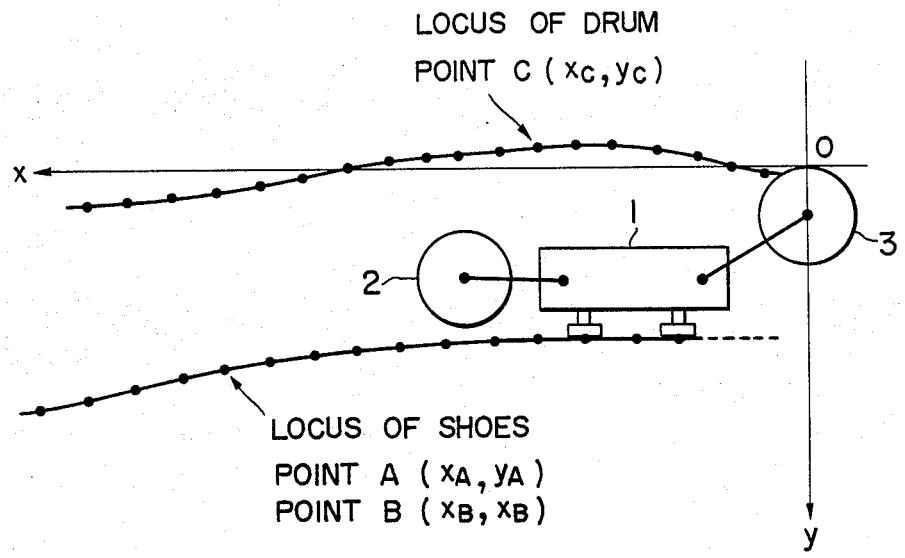

A line obtained by connecting the thus calculated series of coordinates of the bottom portion of the mining face conveyor significantly corresponds to the level of the floor as shown in FIG. 6.

Accordingly, at the operation of the shearer based on the playback mode, by confirming the positions of the shoes 24 and 25 and hence the position of the shearer body 1, the swivelling angle of the arm required for contacting the drum 2 on the main gate side to the floor directly below the drum 2 is obtained irrespective of the position of the shearer body 1.

The playback control mode will be described hereunder with reference to the flowchart shown in FIG. 9.

At the step (a), the travelling position of the shearer body 1 is obtained by the pulse generator 11. At the next step (b), the coordinates of the upper end of the drum 3 at the time when the shearer body 1 is positioned at the thus obtained position are read out from the memory of the computor and coordinates ($x_f$, $Y_f$) of the lower end of the drum 3 satisfying the set value of the working height are then calculated. The coordinates ($x'_e$, $Y'_e$) of the lower end of the drum stored in accordance with the teaching mode are then read out at the step (c). At the subsequent steps (d) and (e), the values $Y'_e$ and $Y_f$ are compared with each other, and in case of $Y'_e > Y_f$ and $Y'_e - Y_f > 50$ mm, an overcutting operation is performed until the value $Y_f$ reaches the value ($Y'_e - 50$) mm at the step (f). On the other hand, in case of $Y_f - Y'_e > 50$ mm at the next step (g), an undercutting operation is performed until the value $Y_f$ reaches the value ($Y'_e + 50$) mm at the step (h). In these steps, with the position of the shearer body in the X-axis direction, since the actual position thereof is substantially equal to the position stored, the value $x'_e$ is nearly equal to the value $x_f$, i.e., $x'_e = x_f$.

According to the steps mentioned above, the height of the roof and the value of the working height setter are compared with each other, and in accordance with the compared result, a portion of the floor to be cut is discriminated. In this comparison, when the difference therebetween exceeds 50 mm, it is difficult to shift the shield supports, so that the overcutting or undercutting operation is performed so as not to exceed the difference of 50 mm. It should be noted that the value 50 mm is of course changeable on the basis of the initial setting thereof.

Figure 7:
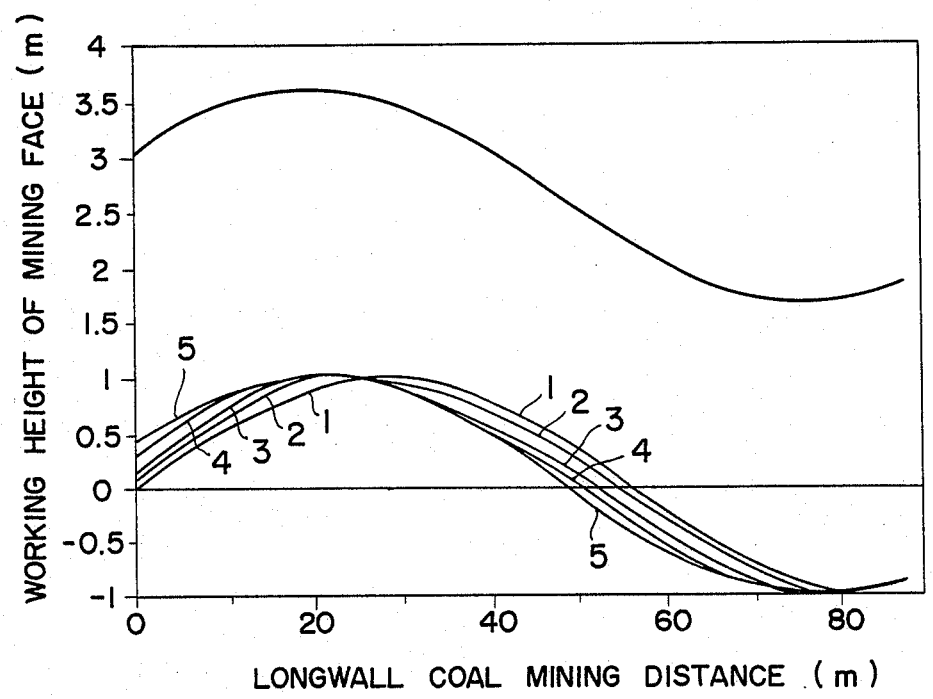
FIG. 7 is a graph showing a cutting process in use of the shearer of this invention.
Figure 9:
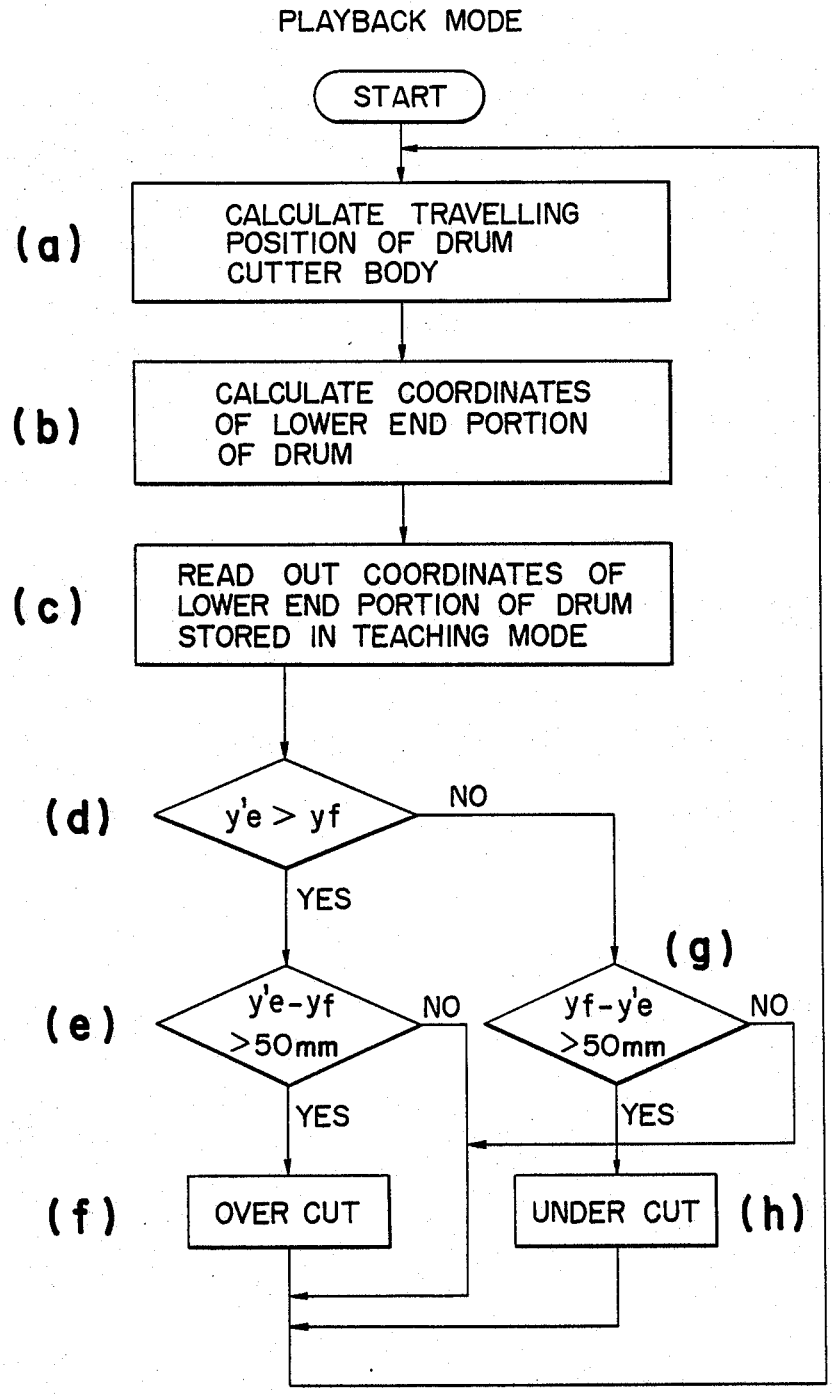

By repeating these steps of the flowcharts shown in FIGS. 8 and 9, the height of the mining face is gradually converged to a constant height predetermined as the aimed final value as shown in FIG. 7, and thereafter, the drums are controlled so that the thus obtained height is constantly maintained.

With the UNI-DIRECTION operation mode described hereinabove, the other drum 2 is left as it is at an intermediate position between the roof and the floor, and the control of the height thereof is not performed. However, in a certain case in which the floor has a large difference in the level, there is a fear of accidentally cutting the roof or floor by the drum 2 positioned on the tail gate side. In order to avoid such accidental cutting, it is required for the drum 2 to automatically control the height thereof, and in such a case, a controlling mode substantially indentical to that referred to hereinbefore may be adopted. According to this mode, it becomes possible to always cut a portion above the floor by about 20 cm, for example.

For the BI-DIRECTION method, substantially the same control mode as that to the UNI-DIRECTION method is adopted. In this method, during the movement of the shearer from the tail gate towards the main gate, the operator manually handles the drum 3 on the main gate side to perform the amendment of the condition of the roof to obtain the most suitable roof condition. This operation corresponds to the teaching with respect to the controlling device. The height of the drum 3 positioned on the main gate side and the inclination of the cutter body 1 are stored at every unit movement distance (for example, 0.5 m) in compliance with the movement of the shearer. Accordingly, as stated with reference to the UNI-DIRECTION method, the position of the roof as well as that of the floor can be obtained by calculation, so that the drum 2 positioned on the tail gate side can automatically cut the aimed portion of the floor.

When the shearer is operated from the main gate side towards the tail gate side, the drum 3 on the tail gate side is operated as a proceeding drum, which is positioned on the leeward, and for this positional reason, it becomes difficult to visually observe or manage the drum 3. Thus, the drums 2 and 3 on the main gate side and the tail gate side have to be automatically controlled on the basis of the data obtained by the teaching mode operation.

Figure 10:
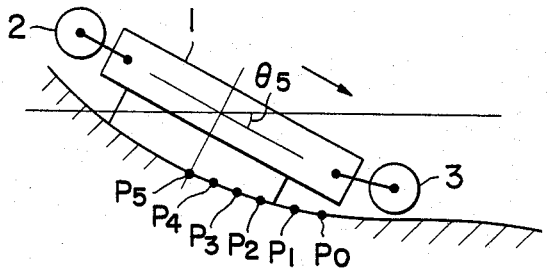
FIGS. 10*a* through 10*e* are illustrations of side views of the double ranging shearer shown in FIG. 1 for explaining a series of operation thereof in accordance with another embodiment of the method of this invention.
Figure 10:
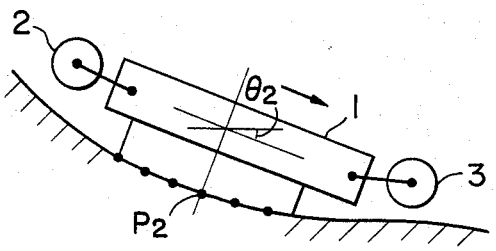
Figure 10:
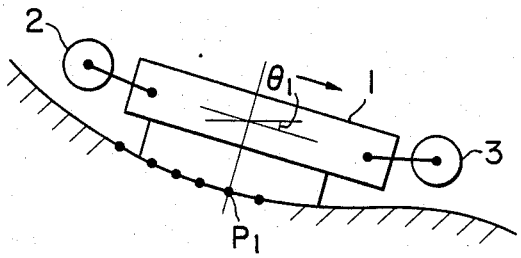
Figure 10:
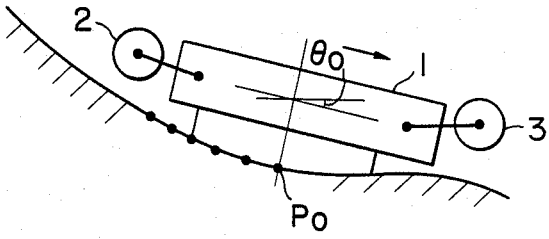
Figure 10:
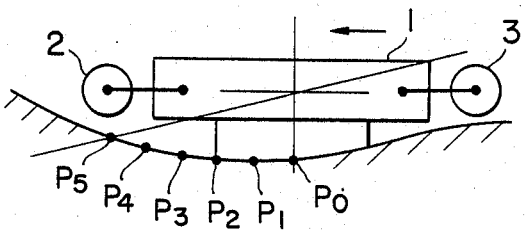

FIGS. 10(*a*) through 10(*e*) show another embodiment according to this invention in which is illustrated the double ranging shearer at a series of the operating positions in accordance with the order to be controlled. FIGS. 10(*a*) through 10(*d*) represent the teaching mode and FIG. 10(*e*) represents the playback mode.

With this embodiment, the present position of the shearer body 1 is first obtained, and the inclination angle thereof at that position is measured as the reference inclination angle. Then, the difference between the reference angle and an inclination angle of the shearer body at a position in every unit travelling distance continuously, and the thus continuously obtained differences are connected in series as a vector curve which is to be controlled as the floor position. In this control, the position of the floor ranging from the front drum to the rear drum is deemed as the aimed position and the other positions out of this range is not required. These steps, however, have to be repeated at every time of the cutter travelling.

According to this embodiment, it is advantageous in comparision with the former embodiment to require no complicated calculation of trigonometrical functions. Moreover, one conveyor used for the mining face in the pit usually has a length of about 1.2–1.5 m, and hence the maximum allowable shift angle thereof is about 1.5° in view of the mechanical limit even in a large level difference of the floor. According to this fact, the function $\sin\theta$ will be deemed to be nearly $\theta$ (i.e. $\sin\theta = \theta$), and therefore, a relatively simple operation bases on the four rules of arithmetic can be adopted for the control method of this invention, thus achieving the high speed operation of the control mode.

According to the described embodiments, the operation of the shearer can be handled by one operator, whereas two operators are required in the conventional operation, and the working height at the mining face can easily be properly controlled without requiring specific experience or expert skill. In addition, according to the double ranging shearer of this invention, since the level condition of the floor can be operated throughout substantially the whole length of the mining face in accordance with the values obtained by the pulse generator for detecting the position of the shearer and the inclination detector for detecting the inclined angle of the shearer, the level condition of the floor can be totally grasped and then stored, thus mining the coal while automatically controlling the working height to a constant height desired throughout the whole length of the mining face.

What is claimed is:

1. A double ended ranging drum shearer capable of controlling a working height of a mining face in a pit, comprising:

a shearer body;

a drum disposed at each of a front and rear end portion of said shearer body, each said drum being movable upwardly and downwardly;

a respective arm member operatively connected to each of said drums for adjusting the height of said drums;

controlling means attached to said shearer body and operatively connected to control said arm members to thereby adjust the height of said drums;

a potentiometer operatively connected to a said arm member and to said controlling means for detecting the height of one of said drums;

means operatively connected to said controlling means for detecting an inclination of said shearer body; and, means operatively connected to said controlling means for detecting a traveling position of said shearer body;

said controlling means operating during a teaching mode in which an operator manually controls the height of said one drum to store data representing the drum heights necessary for maintaining the working height of said mining face constant in accordance with output signals generated from said drum height detecting means, said inclination detecting means, and said traveling position detecting means, at least one of said arm members being operated during a playback mode to automatically adjust the height of at least one of said drums in response to an output signal from said controlling means representing the drum height needed to maintain said working height constant.

2. A method of controlling a working height of a mining face in a pit by using a shearer which repeatedly traverses between a main gate and a tail gate and which includes a shearer body and a pair of drums disposed at front and rear end portions of the shearer body to be movable upwardly and downwardly through respective drum height adjusting means, comprising the steps of:

(a) in a first half-cycle operation in which an operator manually controls the height of one of said drums and in which the shearer body is moved in one direction between the main gate and the tail gate along the mining face, (i) detecting and storing a number of traveling positions, spaced apart along the mining face, of the shearer body;

(ii) detecting and storing a height of said one drum at each of said detected traveling positions of the shearer body;

(iii) detecting and storing the inclination of the shearer body at each of said detected traveling positions; and (iv) controlling mathematically a height of the other drum necessary for maintaining a working height constant in accordance with the stored data representing the detected traveling positions, the height of said one drum and the inclination of the shearer body; and, (b) in a second half-cycle operation in which the shearer body is moved in the other direction between the tail gate and the main gate, (i) controlling the height of at least one of said drums in accordance with data stored in the first half-cycle operation.

3. The method according to claim 2, wherein control of drum height is carried out by regulating the rotation angles of arm members disposed on said drums and said shearer body.

4. The method according to claim 2, wherein coordinates of respective positions of the shearer at a time when said shearer is positioned at at least one position at the mining face during said first half-cycle operation are stored as a series of data including detected data regarding the drum height, the shearer body inclination, and the shearer body traveling position, said drum height adjusting means, for at least one of said drums, being controlled by the stored series of data during said second half-cycle operation.

5. The method according to claim 4, wherein said series of data includes data obtained in accordance with mathematical trigonometrical functions.

* * * * *